US008297026B1

(12) United States Patent
Bracegirdle

(10) Patent No.: US 8,297,026 B1
(45) Date of Patent: Oct. 30, 2012

(54) CONSTRUCTION SYSTEM AND METHOD HAVING INTEGRATED PLANK AND FRAMING MEMBERS

(76) Inventor: Paul E. Bracegirdle, Newtown, PA (US)

( * ) Notice: Subject to any disclaimer, the term of this patent is extended or adjusted under 35 U.S.C. 154(b) by 235 days.

(21) Appl. No.: 12/723,612

(22) Filed: Mar. 12, 2010

Related U.S. Application Data

(60) Provisional application No. 61/227,433, filed on Jul. 21, 2009.

(51) Int. Cl.

| | |
|---|---|
| ***E04B 1/14*** | (2006.01) |
| ***E04B 1/19*** | (2006.01) |
| ***E04G 21/00*** | (2006.01) |
| ***B44F 7/00*** | (2006.01) |
| ***B44F 9/02*** | (2006.01) |

(52) U.S. Cl. ..... 52/745.19; 156/61; 428/15; 428/212; 52/745.17

(58) Field of Classification Search ..... 52/745.19, 52/741.1, 745.15, 747.17; 156/60, 806, 61, 156/130; 160/640, 711, 805, 717; 264/177.11, 264/37.19, 603, 642, 634, 165, 219–220, 264/239, 250, 272.13; 428/15, 170, 212, 428/218

See application file for complete search history.

(56) References Cited

U.S. PATENT DOCUMENTS

| | | | | |
|---|---|---|---|---|
| 2,425,079 | A * | 8/1947 | Billig | 52/88 |
| 3,271,917 | A * | 9/1966 | Rubenstein | 52/309.17 |
| 3,489,626 | A * | 1/1970 | Rubenstein | 156/86 |
| 5,674,802 | A * | 10/1997 | Sheppard | 502/439 |
| 2003/0188667 | A1 * | 10/2003 | Beard et al. | 106/644 |
| 2004/0175563 | A1 * | 9/2004 | Okerson | 428/331 |
| 2008/0099122 | A1 * | 5/2008 | Andersen et al. | 156/60 |

* cited by examiner

*Primary Examiner* — Jeanette E. Chapman
(74) *Attorney, Agent, or Firm* — LaMorte & Associates, P.C.

(57) ABSTRACT

A system and method of manufacturing synthetic construction elements that replaces lumber. A synthetic composition is provided containing cementitious material, synthetic fibers, and low-density particulate material. At least one polymer may be added to improve performance. The density of the synthetic composition is controlled by varying the volume of the low-density particulate material in the mix. Reinforcement elements are provided. The reinforcement elements are preferably pre-stressed or post-stressed in tension. The synthetic compound is molded around the reinforcement elements to form a construction element of a particular shape. The molding of the synthetic material around the reinforcement elements can be a two-step process. In the first step, a first synthetic compound of a high density is molded into a rough form around the reinforcement elements. A second synthetic compound of a lower density and strength is then molded around the rough form to complete the construction element.

13 Claims, 4 Drawing Sheets

CONSTRUCTION SYSTEM AND METHOD HAVING INTEGRATED PLANK AND FRAMING MEMBERS

RELATED APPLICATIONS

This application claims the benefit of Provisional Patent Application No. 61/227,433, entitled Decking System And Method Having Integrated Plank And Framing Members, filed Jul. 21, 2009.

BACKGROUND OF THE INVENTION

1. Field of the Invention

In general, the present invention relates to synthetic building materials that can be used in place of traditional lumber and wood products. More specifically, the present invention relates to the use of cement-based compositions formed into synthetic lumber and used in the application of a simplified, low cost, and integrated deck structure, frame and plank system.

2. Prior Art Description

Wood has been used as a building material throughout human history. Wood is a nearly perfect building material. It is lightweight, strong, and flexible. Wood can be cut, carved, and sanded into almost any shape using only simple handheld tools. Furthermore, in the past, wood has been both plentiful and inexpensive. However, as forests retreat, wood is becoming increasingly more expensive. Additionally, the quality of wood has been decreasing as younger trees have been forested to meet the world's demand for wood products.

Although wood is a highly versatile building material, it does have some disadvantages. Wood, being an organic material, is vulnerable to rot, insect damage and degradation from both the elements and a host of microorganisms. Accordingly, wood must be treated and/or painted, especially if it is left exposed to the elements. Additionally, although wood has an average strength, no two pieces of wood have the same properties. The strength, flexibility, density and even appearance of a piece of wood depends largely upon the type of tree from which the wood came, the part of the tree from where it was cut, the direction of grain in the wood, and the number of knots and other imperfections that are present in the wood.

In an attempt to make building materials that are more uniform and more resistant to the elements, synthetic compositions have been used in place of wood. Many traditional wooden products, such as deck components are now made from synthetic materials. The synthetic compositions used to make traditional wood building products vary. If the building product is ornamental, it may be molded from plastic. However, if the building product must withstand static or dynamic loading, the building product is typically made by mixing either filler or wood with a cement or a plastic binder. Synthetic building products made from such compositions are typically much more resistant to rot and insects than is natural wood. Furthermore, such synthetic building products are also far more uniform in strength, flexibility, density, and appearance from piece to piece. However, such synthetic building products are typically heavier, subject to creep, more brittle, and much weaker in tension than are natural wood products. Such synthetic building materials also tend to be considerably more expensive than those made from natural wood. Accordingly, many synthetic building products have not found wide acceptance in the marketplace.

The products and uses for such building materials comprise many applications. In one large market application, such wood or synthetic building materials are used to produce decks and boardwalks. The construction of decks and boardwalks are complex with many columns, piers beams, joists, and deck planks. Consequently, considerable materials, fasteners, and labor are required to construct such decks and boardwalks.

A need exists for a new composition for synthetic building materials that more closely mirrors the strength, flexibility, and tensile strength of wood, while still providing better resistance to weathering and insects. A need exists for a composition and shape for such synthetic building materials that can be manufactured inexpensively so as to compete with the costs to design and build with the natural wood products. A need also exists for a construction system that simplifies the construction of deck and boardwalk projects. These needs are met by the present invention as described and claimed below.

SUMMARY OF THE INVENTION

The present invention is a system and method of manufacturing synthetic construction elements that can be used to replace lumber. A synthetic composition is provided that is comprised of cementitious material, synthetic fibers, and low-density particulate material. In some instances, at least one polymer may be added to improve performance. The density of the synthetic composition is controlled by varying the volume of the low-density particulate material in the mix.

Reinforcement elements are provided. The reinforcement elements can be pre-stressed or post-stressed in tension. The synthetic compound is molded around the reinforcement elements to form a construction element of a particular shape. If the reinforcement elements are pre-stressed, the pre-stress forces are removed from the reinforcement elements after the synthetic compound cures. If the reinforcement elements are post-stressed, the post-stress forces are applied after the synthetic compound cures. Such post-stressed reinforcement can also be inserted through holes or conduits and the tension applied after curing and prior to use.

The molding of the synthetic material around the reinforcement elements can be a two-step process. In the first step, a first synthetic compound of a high density and strength is molded into a rough form around the reinforcement elements. A second synthetic compound of a lower density and strength is then molded around the rough form to complete the construction element. By using materials of different densities, both the strength and the weight of the resulting construction element can be optimized.

The low-density synthetic compound and the high-density synthetic compound can have the same ingredients. However, by varying the volume of low-density particulates in the compound, the compound can be made at different densities.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention system and method can be used to make a variety of building materials, such as framing components, the present invention is especially well suited for use in making building materials that remain exposed to the elements. Accordingly, the exemplary embodiment of the invention illustrates and describes a system and method that is used to make footings, posts, beams, and decking tees for decks and boardwalks. Such an exemplary embodiment is selected to set forth one of the best modes contemplated for the invention. However, the use of such an exemplary embodiment should not be considered a limitation upon the scope of the claims.

Figure 1:
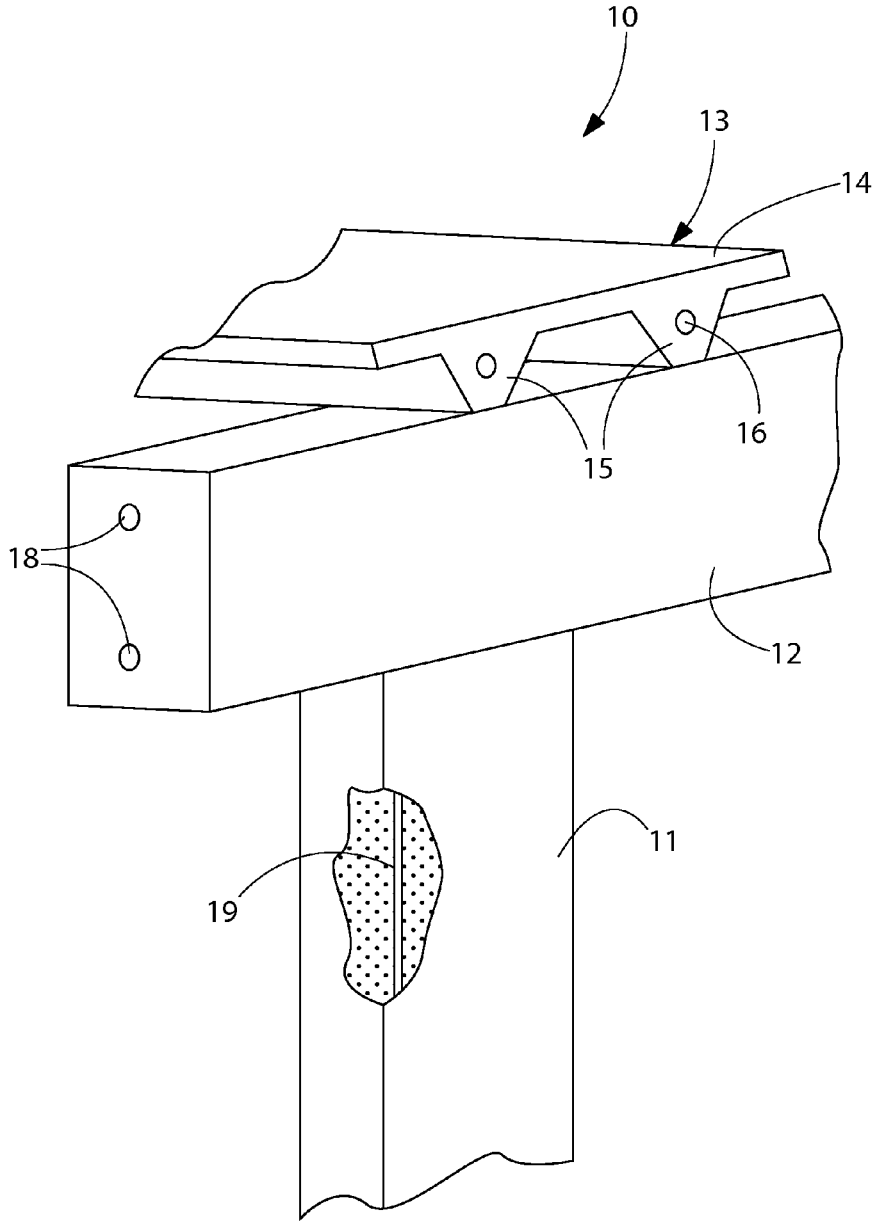
FIG. 1 is a partially fragmented perspective view of an exemplary embodiment of a construction containing a pier, crossbeam and decking tee in accordance with the present invention.

Referring to FIG. 1, a decking framework 10 is shown containing piers 11 and crossbeams 12 in accordance with the present invention. Decking tees 13 extend over the crossbeams 12 to create a walking surface. The decking tee 13 provides an integrated framing member and walking surface in a single structural element.

Figure 2:
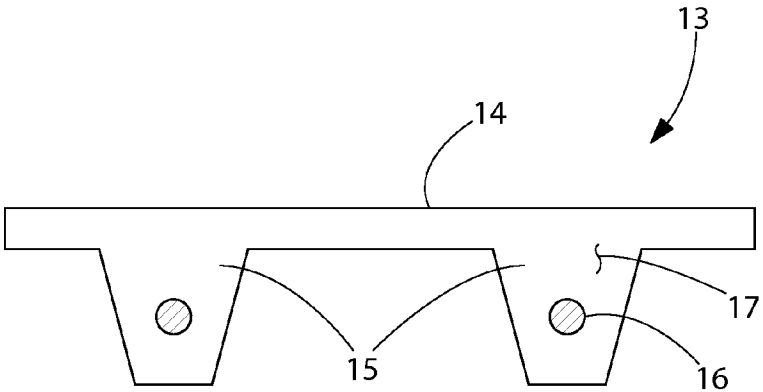
FIG. 2 is a front view of a decking tee.

Referring to FIG. 2 in conjunction with FIG. 1, it can be seen that each of the decking tees 13 contain a flat top section 14 and at least one support rib 15. The illustrated embodiment has two support ribs 15. More or less than two support ribs 15 can be used depending upon the width of the flat top section 14. The support ribs 15 run the length of the flat top section 14 and extend downwardly from the underside of the flat top section 14. The support ribs 15 provide the flat top surface 14 with the rigidity comparable to a plank of wood. However, by using support ribs 15, the weight of the decking tees 13 are kept to a minimum, thereby enabling the weight of the decking tee 13 to be comparable in weight to a wooden plank and frame.

Internal reinforcement elements 16 are disposed within the support ribs 15. The reinforcement elements 16 are preferably pre-stressed before the formation of the support ribs 15. However, the reinforcement elements 16 can also be post-tensioned after the formation of the decking tee 13.

The reinforcement elements 16 can be steel rods or steel mesh. However, lightweight non-metal alternatives, such as carbon fiber rods, basalt rods or fiberglass rods can be used. If the reinforcement elements 16 are pre-stressed, a tensioning force is applied to the reinforcement elements 16 before the reinforcement elements are embedded within the support ribs 15. If the reinforcement elements 16 are to be post-tensioned, then openings are formed in the support ribs 15 that enable the support ribs and the reinforcement elements 16 to be tensioned after the formation of the support ribs 15.

The reinforcement elements 16 are molded within a cured synthetic composition 17. Once the synthetic composition 17 is cured, the resulting decking tee 13 has both strength and flexibility characteristics that are comparable to that of natural wood.

Both the piers 11 and crossbeams 12 may also contain reinforcement elements 18, 19 similar to those found in the decking tees 13.

In order for the pier 11, cross beams 12 and/or decking tee 13 to mimic natural wood, it preferably has a pre-stress reinforcing bond at a compressive strength of at least 2,500 PSI and a final compressive strength of at least 3,000 PSI and a density under 120 pounds per cubic foot. Although the density of each pier 11, cross beams 12 and/or decking tee 13 can be uniform, it need not be. Less material can be used if the density of each element is made greater closest to the reinforcement elements 16, 18, 19 and lesser at other points.

The use of reinforcement elements 16, 18, 19 provide the pier 11, cross beams 12 and decking tee 13 with the wood-like ability to bend slightly without breaking. In the present invention, the internal reinforcement elements 16 are manufactured within the decking tees 13. Reinforcement elements 18, 19 are also manufactured into the crossbeams 12 and the piers 11. However, in order for the internal reinforcement elements 16, 18, 19 to have effect, they must bear some of the tension loads while being encased in the synthetic composition 17. Consequently, the cured synthetic composition 17 must be flexible enough to allow stresses to influence the internal reinforcement elements 16, 18, 19. However, the cured synthetic composition 17 must not crack or otherwise break as it flexes. It is, therefore, important that the cured synthetic composition 17 be minimally but somewhat flexible. However, the window of proper flexibility is small. If the cured synthetic composition 17 is made too rigid, the cured synthetic composition 17 will crack when stressed. If the cured synthetic composition 17 is made too flexible, its compressive strength may be too low and the internal reinforcement elements 16 will have to bear all loading. Furthermore, the synthetic composition may fail to bond to the reinforcement elements 16. Either way, the resulting components would have ultimate strength much lower than that of natural wood.

Figure 3:
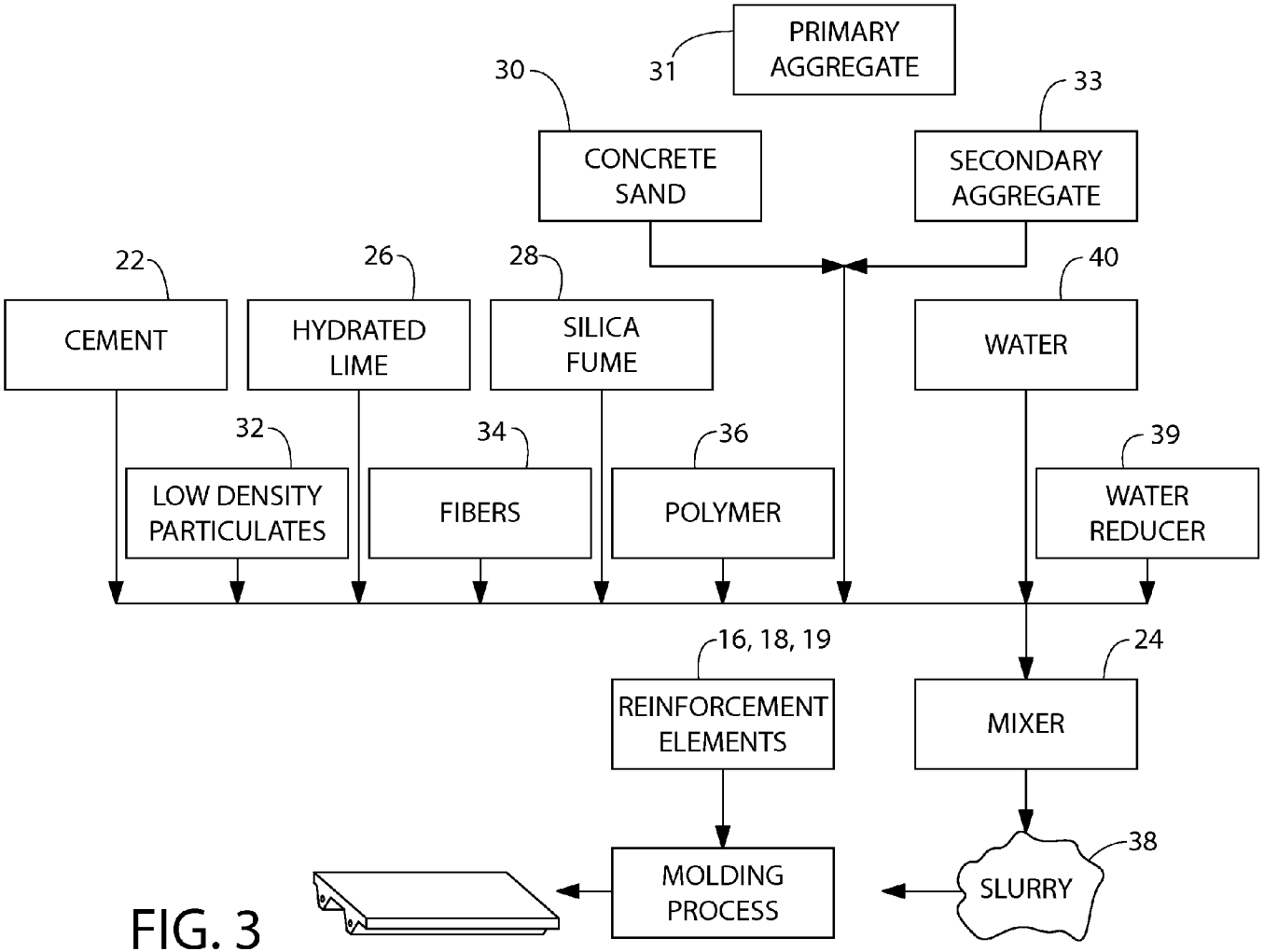
FIG. 3 is a block diagram schematic that illustrates an exemplary composition and method of manufacture for construction elements.

Referring to FIG. 3, details on the cured synthetic composition 17 are presented. The cured synthetic composition 17 is comprised primarily of cementitious material 22. The cementitious material 22 can be type "1", type "2" and/or type "3" cement. Other variations of cement products such as type "K" or even ultra-high-strength cementitious ingredients may also be used. More eco-friendly, environmentally sustainable pozzolans, or cement-like products such as fly ash or finely ground slag may be used as well. The cementitious material 22 is added into a mixer 24 in amounts between 400 and 900 pounds per cubic yard. To help the cementitious material 22 cure with proper strength, silica fume 28 and fine aggregate are added to the mixer 24. The fine aggregate may be a blend of concrete sands 30 and/or lightweight small aggregate 31. Hydrated lime 26 may be added in amounts approximately 40 to 80 pounds per cubic yard. The silica fume 28 may be added in amounts between 40 and 80 pounds per cubic yard. Concrete sand 30 and/or lightweight fine aggregate 31 is added at a concentration of between 300 and 500 pounds per cubic yard. Secondary sands or fine aggregate 33 are added between 400 and 600 pounds per cubic yard.

To decrease the density of the mix, a low density aggregate and/or particulate 32 is added. The low density particulate 32 can be perlite, vermiculite, plastic beads, glass, or even particles of polymer foam. The low-density particulates 32 are added in amounts between 75 and 200 pounds per cubic yard of the mixture. The purpose of the low density particulate 32 is to decrease the density of the cured synthetic composition 17 so that it cures with a density close to that of wood.

To increase the flexibility of the cured synthetic composition 17, reinforcement fibers 34 are added. The reinforcement fibers 34 can be metal. However, the reinforcement fibers 34 are preferably chopped synthetic fibers, such as those that can be obtained from virgin fiber sources or recycled carpeting. The reinforcement fibers are added in amounts from 1 to 10 pounds per cubic yard. Recycled carpeting has an average composition of 45% Nylon fibers, 10% polypropylene, 9% styrene-butadiene polymer and 26% calcium carbonate. Chopped recycled carpeting typically contains fibers that range from 0.1 mm to 5 mm in length. Although recycled chopped carpeting is preferred, synthetic and other reinforcing fibers from other sources can also be used. A method of obtaining such chopped reinforcement fibers is described in, U.S. Pat. No. 7,563,017 of Paul Bracegirdle, entitled Process for Mixing Congealable Materials Such as Cement, Asphalt, and Glue with Fibers from Waste Carpet, the disclosure of which is incorporated into this application by reference.

Water 40 is added to the mixture to produce moldable uncured slurry 38. Approximately, 200 to 350 pounds of water 40 per cubic yard will produce the needed consistency and proper water-cement or water-pozzolan ratio. A water reducing admixture 39, in amounts of approximately 1.5 pounds per 100 pounds of cement, can be added to the mixture to ensure more even mixing, improve flow and increase strength. Other admixtures such as accelerators, retarders and air entraining agents may be added to improve performance for the casting operations and other methods that may be used to form such synthetic building products.

Once all the ingredients are added into the mixer 24, the uncured slurry 38 is mixed to the proper consistency. Prior to the uncured slurry 38 being directed into a mold, the reinforcement elements 16, 18, 19 are placed within the mold. The internal reinforcement elements 16, 18, 19 can be metal wire, cable or bar. However, it is preferred that the internal reinforcement elements 12 be wire or strands. As has been mentioned, the reinforcement elements 16, 18, 19 may be pre-stressed or post-tensioned.

Depending upon the amount of water 40 or water reducer 39 used in the uncured slurry 38, the uncured slurry 38 can be produced as thin slurry or even a self-consolidating mix, suitable for pour molding techniques. The slurry 38 is then poured into the mold and allowed to cure. The resulting components with the internal reinforcement elements 16, 18, 19 can then be cut to length after molding. The length of each of the resulting components can be cut to any length. Short lengths are preferred for consumer components that will be manually lifted and carried. Long lengths can be made for beams that will be lifted and installed by crane.

During the molding process, the uncured slurry 38 forms a desired shape around the internal reinforcement elements 16, 18, 19. The uncured slurry 38 is then either allowed time to cure or is actively heated which reduces curing time. The final result is building materials, such as piers, columns, cross-beams and decking channels or tees, made from the cured synthetic composition 17.

In the system illustrated in FIG. 3, all materials are mixed together in a mixer 24 prior to molding. As such, the resulting synthetic composition has a uniform density throughout. As has been previously mentioned, various construction components can be made lighter by varying the density of the synthetic composition in different areas of the components.

In the manufacturing process illustrated in FIG. 3, it will be understood that the density of the slurry 38 being used for molding is controlled greatly by the volume of the low density particulate 32 added to the composition. Thus, by reducing the volume of low-density particles 32, the overall density of the slurry 38 can be increased. Conversely, by increasing the volume of low-density particles 32, the overall density of the slurry 38 can be decreased.

Figure 4:
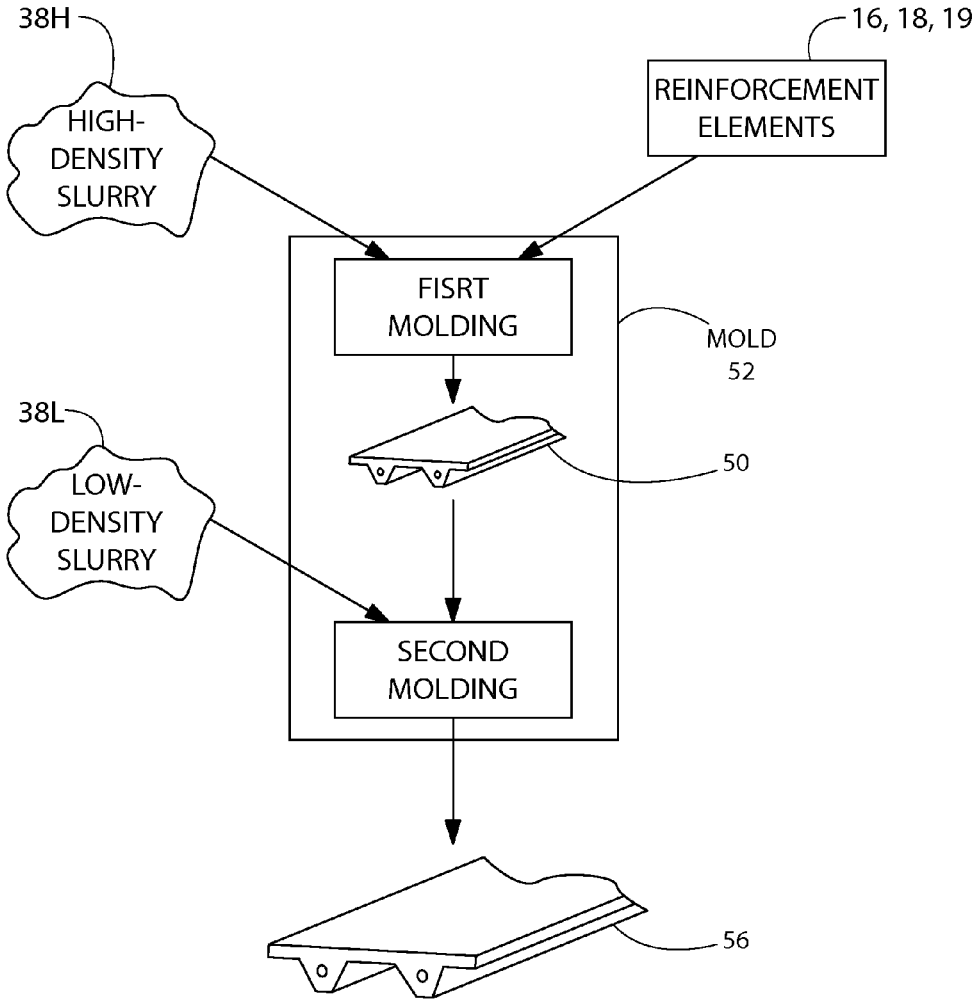
FIG. 4 is a block diagram schematic that illustrates an exemplary method of manufacture for construction elements having variable densities.

Referring to FIG. 4 in conjunction with FIG. 3, a method of making a construction element with high density and low-density sections is explained. Slurry 38 is readied for molding using the methodology previously explained in conjunction with FIG. 3. By varying volume of low-density particulate 32, the slurry 38 can be made into a high-density slurry 38H or a low-density slurry 38L.

The high-density slurry 38H is molded into an incomplete form 50 around reinforcement elements 16, 18, 19 in a mold 52. The reinforcement elements 16, 18, 19 are pre-stressed. The high-density slurry 38H is allowed to cure or at least partially cure. Consequently, the reinforcement elements 16, 18, 19 are encapsulated in an unfinished body of high-density material. The incomplete form 50 is therefore present in the mold 52. A low-density slurry 38L is then poured over the incomplete form 50 in the mold 52. The mold 52 creates the final form of the construction element 56, such as a pier, post or decking tee. After the low-density slurry 38L and the high-density slurry 38H cures, the construction element 56 is removed from the second mold. The result is a construction element that has high-density material surrounding the reinforcement elements and low-density material at other places.

It will be understood that the embodiment of the present invention that is shown is merely exemplary and that a person skilled in the art can make many variations to that embodiment. For instance, the present invention can be made into many other products, such as building and framing lumber, posts, and railing, in addition to the decking piers, beams, and decking tees that are illustrated. Furthermore, additives, such as colorants, mold inhibitors, polymers, crystalline admixtures and the like can also be added to the disclosed compositions. Alternatively, the surface of the decking tees can be stamped, embossed or ground smooth and stained or painted during or after curing or even in the field once installed. Moreover, other methods of similar composition manufacturing techniques, such as dry-pack methods, flat-bed in-situ pre-casting, extrusion and sawn in-place products may be employed. All such variations, modifications, and alternate embodiments are intended to be included within the scope of the present invention as defined by the claims.

What is claimed is:

1. A method of manufacturing artificial lumber, comprising the steps of:

providing a first synthetic composition of a first density;

providing a second synthetic composition of a second density that is less than that of said first synthetic composition;

providing reinforcement elements;

molding said first synthetic composition around said reinforcement elements to create an incomplete form;

molding said second synthetic composition around said reinforcement elements to create a complete section of synthetic lumber.

2. The method according to claim 1, wherein said complete section of synthetic lumber is a decking tee having a flat top surface and at least one support rib extending below said top surface.

3. The method according to claim 2, further including the step of positioning said reinforcement elements within said support ribs.

4. The method according to claim 1, further including the step of pre-stressing said reinforcement elements during said molding of said first synthetic composition.

5. The method according to claim 4, further including the step of pre-stressing said reinforcement elements during said molding of said second synthetic composition.

6. The method according to claim 1, wherein both said first synthetic composition and said second synthetic composition contain a mixture of cementitious material, fibers, and a curable polymer.

7. The method of claim 6, wherein said fibers include recycled carpet fibers.

8. The method of claim 1, wherein said first synthetic composition contains low-density particulate matter in a first concentration and said second synthetic composition contains said low-density particulate matter in a second concentration that is greater than said first concentration.

9. The method according to claim 8, wherein said low-density particulate matter is selected from a group consisting of perlite, vermiculite, glass beads and plastic foam beads.

10. The method according to claim 1, wherein said first synthetic composition and said second synthetic composition both further include sand, curing agents and aggregate.

11. The method according to claim 1, wherein said first synthetic composition and said second synthetic composition both further include hydrated lime and silica fume.

12. The method according to claim 1, wherein said first synthetic composition and said second synthetic composition both further include cementitious material is selected from a group consisting of cement, pozzolans, fly ash and finely ground slag.

13. The method according to claim 1, further including the step of applying post-tensioning forces to said reinforcement elements, therein creating stressed reinforcement elements.

* * * * *